United States Patent [19]

Mori

[11] 3,950,913

[45] Apr. 20, 1976

[54] METHOD AND APPARATUS FOR CONSTRUCTING A SUSPENSION BRIDGE TOWER

[75] Inventor: Shigeru Mori, Yokohama, Japan

[73] Assignee: Mitsui Shipbuilding & Engineering Co., Ltd., Tokyo, Japan

[22] Filed: July 16, 1975

[21] Appl. No.: 596,108

Related U.S. Application Data

[63] Continuation-in-part of Ser. No. 422,976, Dec. 7, 1973, abandoned.

[30] Foreign Application Priority Data

Dec. 8, 1972 Japan ..... 47-123178

[52] U.S. Cl. ..... 52/747; 52/749; 52/122; 214/95 R; 214/650 R

[51] Int. Cl.[2] ..... E04D 15/00; B65G 47/00

[58] Field of Search..... 52/745, 747, 749, 122–123, 52/127; 214/1 H, 650–654, 95 R; 14;3;8;23/

[56] References Cited

UNITED STATES PATENTS

| | | | |
|---|---|---|---|
| 1,686,279 | 10/1928 | Kaye | 52/749 |
| 2,566,863 | 9/1951 | Voigt | 214/654 |
| 2,754,012 | 7/1956 | Hines | 214/1 H |
| 3,287,875 | 11/1966 | Lakin | 52/747 |
| 3,679,071 | 7/1972 | Smith | 214/1 H |
| 3,703,028 | 11/1972 | Bosquain | 52/127 X |
| 3,753,413 | 8/1973 | Ichikawa et al. | 214/730 X |
| 3,789,565 | 2/1974 | Lindholm | 52/747 |
| 3,797,684 | 3/1974 | Brandt | 214/654 X |

FOREIGN PATENTS OR APPLICATIONS

| | | | |
|---|---|---|---|
| 1,285,163 | 12/1968 | Germany | 52/747 |
| 1,315,412 | 12/1962 | France | 52/747 |

*Primary Examiner*—Albert J. Makay
*Assistant Examiner*—R. B. Johnson
*Attorney, Agent, or Firm*—Stanley B. Kita

[57] ABSTRACT

Apparatus for constructing a block tower for a suspension bridge includes a working platform, means for raising and lowering the platform vertically along a pre-erected base of the tower, and a carriage movable horizontally on tracks on the working platform. The carriage moves between a block loading station lateral of the base and a block unloading station above the top of the tower base where the block is superimposed on other blocks of the pre-erected base. The carriage is specially designed to raise and lower the lower block and to disengage the same at the block unloading station for return to the block loading station. A method is also disclosed for constructing a tower of built-up blocks.

5 Claims, 7 Drawing Figures

METHOD AND APPARATUS FOR CONSTRUCTING A SUSPENSION BRIDGE TOWER

This application is a continuation-in-part of application Ser. No. 422,976 filed on Dec. 7, 1973, now abandoned, for Apparatus For Constructing The Tower For The Suspension Bridge.

The present invention relates to an apparatus for constructing suspension bridge towers.

A primary object of the present invention is to provide a method and apparatus for constructing easily large and tall suspension bridge towers.

A more specific object of the present invention is to provide novel apparatus for constructing a tower of built-up blocks. The apparatus comprises a working platform, climbing means for raising and lowering the platform along pre-erected base means, and a carriage mounted on the platform for movement on tracks between a block loading station lateral of the tower and a block unloading station above the tower. The carriage includes means for lowering the block onto the pre-erected base and means for disengaging the block after it is lowered to afford return of the carriage to the block loading station.

The present invention also provides, as another specific object, a novel tower constructing method employing the above apparatus.

These and other objects, features and advantages of the present invention should become apparent from the following description and drawings in which.

Figure 1:
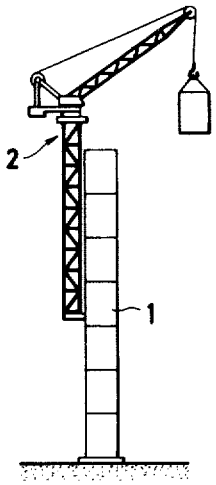
FIG.1 (PRIOR ART)
FIGS. 1 to 3 are schematic diagrams of conventional methods and apparatus for constructing towers.
Figure 2:
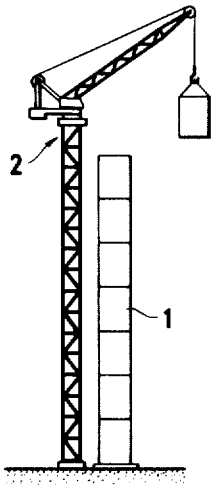
FIG.2 (PRIOR ART)
Figure 3:
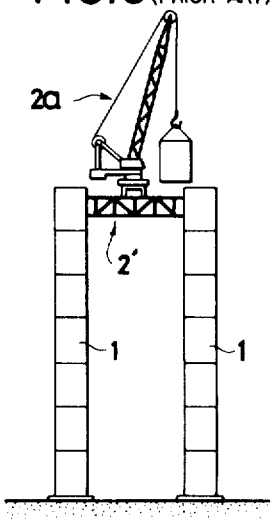
FIG.3 (PRIOR ART)
Figure 4:
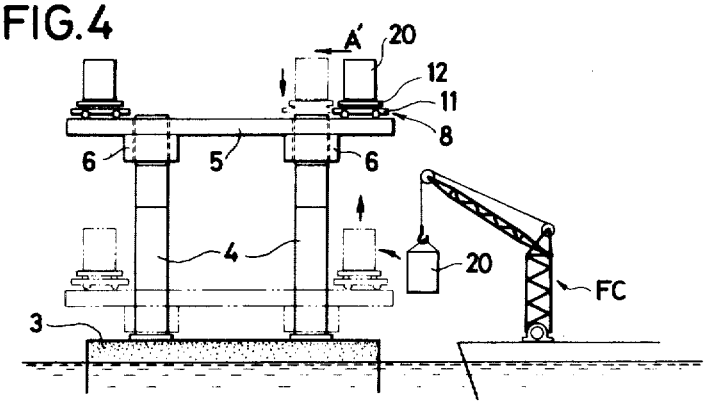
FIG. 4 is a schematic elevational view illustrating apparatus according to the present invention during construction of a pair of towers for a suspension bridge.
Figure 5:
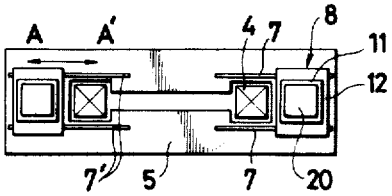
FIG. 5 is a plan view of the apparatus of FIG. 4.

Referring to the drawings, and more particularly to FIGS. 1, 2 and 3, conventional methods for constructing bridge towers include the use of a climbing crane 2 which can climb along the tower 1 as shown in FIG. 1 or the use of a self-standing climbing crane 2 as shown in FIG. 2 for constructing the tower 1 therein. However, in both of these methods it is difficult for large tall towers to be constructed because the climbing cranes do not have a sufficient capacity to suspend the heavy blocks used in the construction of such towers. Furthermore, scaffolds must be provided to enable workmen to connect adjacent blocks together.

In order to eliminate the disadvantages of these conventional methods, the method shown in FIG. 3 has been used. In this method, a working platform 2' mounts a crane 2*a*, and the platform is supported by and movable along a pair of towers 1,1. Due to the load-lifting capacity of the crane 2*a*, heavy weight blocks cannot be raised, so that with this apparatus large towers must be constructed from a plurality of small lighter-weight blocks.

The present invention provides a method and apparatus for constructing the towers for large and tall suspension bridges and for overcoming the above disadvantages of conventional methods and apparatus. The present invention is characterized by apparatus comprising a working platform, climbing means to move the platform vertically along a pre-erected tower base, and a carriage provided on the working platform and movable on tracks between a block unloading position above the top of the tower base and a block loading position adjacent an end portion of the working platform. The carriage comprises a carriage body, a frame provided on the carriage body, and means on the carriage body for supporting and lowering the frame. The body and frame have gates providing openings larger than the width of the tower blocks to permit the carriage to disengage the block at the block unloading position. Thus a block to be superimposed on top of the tower base is placed on the carriage frame and is transferred by the carriage to the block unloading position above the top of the tower, whereupon the frame is lowered to deposit the block. The gates are opened to disengage the carriage from the block so that the carriage can be returned to the block loading position and the cycle repeated.

Referring to FIGS. 4 to 7, pre-erected base means, in the present instance a pair of upstanding base block sections 4,4 of the tower to be erected, is provided on a base or foundation 3, and a working platform 5 which is movable vertically along the base means by lifting means 6 is provided. The lifting means 6 is conventional and may be provided by a variety of different structures such as the structure disclosed in U.S. Pat. No. 3,565,400 (issued on Feb. 23, 1971 to the assignee of the present application) which is incorporated by reference herein. Other types of conventional lifting devices are disclosed in U.S. Pat. Nos. 2,970,445 and 2,944,403.

In the illustrated embodiment, a block-transporting carriage 8 is provided on spaced parallel rails 7 and 7' which extend lengthwise of the platform 5 on opposite sides of the tower base means 4. See FIG. 5. The carriage 8 is movable on the guide rails 7 and 7' forwardly from a block loading station lateral (to the right) of the right tower base 4 and into a block unloading station overlying the right tower base 4. Both of these stations are indicated in broken lines in FIG. 4. Preferably the carriage 8 is displaced by a conventional power drive means which propels it on the rails 7 and 7'; however, the carriage 8,8 may simply be pushed from station to station by workmen standing on the platform 5.

Figure 6:
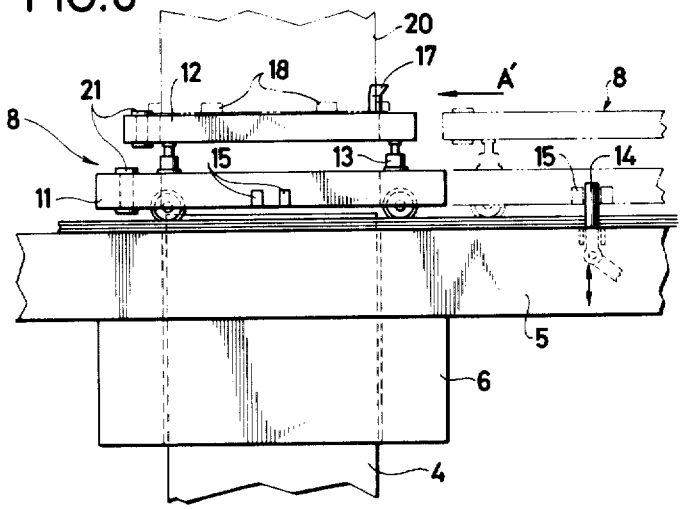
FIG. 6 is an enlarged fragmentary side elevational view of the apparatus of the present invention.
Figure 7:
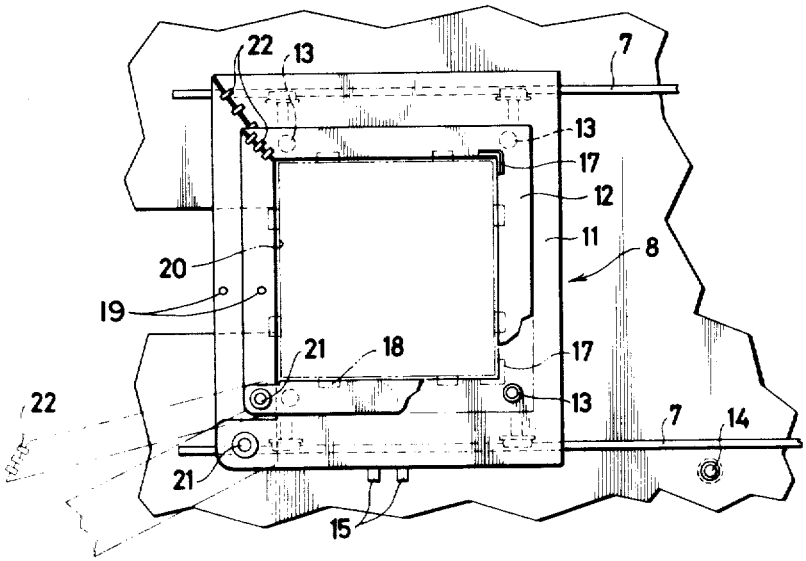
FIG. 7 is a plan view of the apparatus illustrated in FIG. 6.

As best seen in FIGS. 6 and 7, the carriage 8 comprises a carriage body 11 and a carriage frame 12 each having an opening in plan corresponding to the cross-section of the block 20 which, in the present instance, is square. The frame 12 is supported on the body 11 by oil hydraulic cylinders 13,13 which provide means for raising and lowering the frame 12 with respect to the carriage body 11. As seen in FIG. 6, the frame 12 surrounds and supports the lower portion of a block 20 (indicated in broken lines). Preferably the block 20 is provided with a series of removable peripheral protrusions 18,18 which engage the topside of the frame 12.

The body and frame of the carriage 8 are designed to afford their disengagement from the block 20 at the block unloading station. To this end, the front end of each of them is provided with a gate 19 pivotally connected at one end to the body 11 and frame 12 by the pins 21,21 and fixed to the body 11 and frame 12 at the other end by the clamps 22,22 as shown in FIG. 7. The gates 19,19 provide a means for releasing the carriage 8 from the block 20 by providing an opening at the front of the carriage 8 slightly larger than the size of the block. Thus, the gates 19 may be swung open from the closed position (illustrated in full lines in FIG. 7) when the carriage 8 is transporting the block 20 and into the open position (illustrated in broken lines in FIG. 7) when the carriage 8 is being disengaged from the block 20 at the block unloading station.

In using the apparatus of the present invention, the tower base sections 4,4 are pre-erected on the foundation 3 by using the floating crane FC, and the working platform 5 is mounted on the upstanding base sections 4,4. The carriage 8 is located at the loading station on the end portion of the working platform 5 and is releasably secured at this location by stoppers or keepers 14 on the platform which engage between a pair of side projections 15,15 of the carriage body 11. Thereafter the block 20 (which preferably has been constructed on the land) is deposited on the frame 12 of the carriage 8 by the floating crane FC. The block 20 is supported on the upper surface of the frame 12 by the protrusions 18 after being properly guided into position on the frame by the guides 17,17 on the frame 11. Then, the working platform 5 is elevated by the lifting means 6 to the upper end of the pre-erected base means 4. The keepers 14 are retracted from the projections 15,15, and the carriage 8 is displaced forwardly in the direction of the arrow A' into a position above the base means 4 as shown in FIG. 6.

The working platform 5 is then lowered slightly, and the frame 12 is lowered by the cylinders 13 to lower the block 20 on the previously-placed block 4. The block 20 is then securely fastened to the block 4, as by welding, and the protrusions 18,18 on the block 20 are removed. The clamps 22,22 of the carriage body 11 and carriage frame 12 are released, and the gates 19,19 are pivoted into the open or block-release position illustrated by dotted lines in FIG. 7. The carriage 8 is then returned rearwardly in the direction opposite the arrow A' to disengage the carriage 8 from the block 4 and to reposition the carriage at the block loading station. The carriage 8 is then secured in the block loading station by the keeper 14. Thereafter, the working platform 5 is lowered toward the foundation 3 by the lifting means 6 and is placed in the position illustrated in dotted lines in FIG. 4. The next block 20 is mounted on the carriage 8, and the above-mentioned steps are repeated. In this manner, a tower is constructed employing the method and apparatus of the present invention.

In view of the foregoing, it should be apparent that the present invention provides apparatus for constructing towers of relatively large heavy blocks. This is made possible by the use of the vertically-movable working platform in combination with the carriage and its block lowering and releasing means. In addition, the present invention eliminates the need for scaffolding to enable workmen to connect adjacent blocks as had been required with prior art apparatus.

While a preferred method and apparatus has been described in detail, various modifications, alterations and changes may be made without departing from the spirit and scope of the present invention as defined in the appended claims.

I claim:

1. Apparatus for erecting a tower comprising:

pre-erected base means adapted to receive blocks superimposed one upon another, a platform extending laterally with respect to the base means, said platform having a block loading station lateral of said base means and a block unloading station directly overlying said base means, climbing means connected to said platform and engaging said base means to displace said platform vertically relative to said base means, a carriage mounted on said platform for movement thereon forwardly from said block loading station to said block unloading station for transporting one of said blocks to said block unloading station, means on said carriage for lowering said one block onto said pre-erected base means after said carriage has been displaced into said unloading station, and means for releasing said carriage from said one block at said unloading station onto said pre-erected base means to afford rearward return of said carriage unloaded to said loading station, said releasing means including a frame adapted to surround and support a lower portion of said one block and a gate at the forward end of the frame sized to permit passage of said carriage rearwardly relative to said one block for return to said loading station after said block has been lowered onto said base means.

2. Apparatus according to claim 1 wherein said frame means includes upper and lower frame portions and hydraulic means mounting said upper portion for movement vertically relative to said lower portion to provide said block lowering means, said upper portion of said frame means being engageable against said one block to support and to lower the same relative to said platform.

3. Apparatus according to claim 1 including means on said platform extending between said block loading and block unloading stations to guide said carriage on said platform between said stations, and means on said platform and carriage cooperating at said block loading station to releasably secure said carriage at said block loading station.

4. Apparatus according to claim 1 wherein said base means includes a pair of horizontally-spaced upwardly-projecting sections and said platform extends between said sections.

5. A method of erecting a tower having pre-erected base means adapted to receive blocks superimposed one upon another by employing apparatus comprising a platform having a block loading station lateral of said base means and a block unloading station directly overlying said base means, means engaging said base means for raising and lowering said platform, a carriage moveable on said platform between said loading and unloading stations, said carriage having a frame adapted to surround a lower portion of one block and a gate sized to permit passage of said carriage laterally relative to said block, means on said carriage for lowering one block onto said base means, and means for releasing said carriage from a block at said loading station, said method comprising the steps of:

depositing one of said blocks on said carriage at said block loading station, elevating said platform on said base means with said carriage at said block loading station to dispose the platform at a level adjacent the top of the pre-erected base means, displacing said carriage with said one block to said block unloading station, lowering said one block from said carriage and onto said pre-erected base means, opening said gate on said frame to release said carriage from said lowered one block at said block unloading station, returning said carriage unloaded to said block loading station, lowering said platform with said carriage at said block loading station, and repeating the above steps to superimpose additional ones of said blocks onto said base means, whereby the tower is erected.

* * * * *